US006567623B2

(12) United States Patent
Kobayashi

(10) Patent No.: US 6,567,623 B2
(45) Date of Patent: May 20, 2003

(54) IMAGE FORMING APPARATUS AND IMAGE FORMING METHOD

(75) Inventor: Yukie Kobayashi, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/948,659

(22) Filed: Sep. 10, 2001

(65) Prior Publication Data

US 2003/0049041 A1 Mar. 13, 2003

(51) Int. Cl.[7] ..... G03G 15/02
(52) U.S. Cl. ..... 399/50; 399/170
(58) Field of Search ..... 399/50, 170

(56) References Cited

U.S. PATENT DOCUMENTS 5,832,340 A * 11/1998 Kosagi et al. ..... 399/88

FOREIGN PATENT DOCUMENTS

JP 6-35293 * 2/1994
JP 10-339987 12/1998

* cited by examiner

*Primary Examiner*—Quana M. Grainger
(74) *Attorney, Agent, or Firm*—Foley & Lardner

(57) ABSTRACT

A control circuit of a digital copying machine sets a total current to a charger at a high level in a printing operation, sets the total current to the charger at a low level when turn-off of power to the digital copying machine has been instructed to initiate a finishing operation, and turns off the total current to the charger when the finishing operation has been completed.

5 Claims, 5 Drawing Sheets

IMAGE FORMING APPARATUS AND IMAGE FORMING METHOD

BACKGROUND OF THE INVENTION

The present invention relates to an image forming apparatus, such as a copying apparatus or a printer, having a charger using an electrophotographic process.

A conventional image forming apparatus using an electrophotographic process, such as a copying apparatus or a printer, includes an image forming section for forming an image based on image data and outputting the image onto a recording medium such as a paper sheet.

The image forming section has a photosensitive body which retains an electrostatic latent image corresponding to image data. In the image forming apparatus, the following elements are disposed around the photosensitive body in order in its rotational direction: a charger for charging a surface of the photosensitive body at a uniform potential; an optical scanning device, such as a laser exposure device, for exposing the charged photosensitive body to form an electrostatic latent image; a developing device for applying a developer, or a toner, to the electrostatic latent image to form a toner image; a transfer charger for transferring the toner image on the photosensitive body onto a recording medium such as a paper sheet; a separating charger; a cleaning device for removing toner remaining on the photosensitive body after the transfer of the toner image; and a charger erase device for eliminating charge remaining on the photosensitive body.

The charger included in the image forming section is disposed with a predetermined distance from the surface of the photosensitive body. The charger electrifies the surface of the photosensitive body by means of a corona charger.

In the image forming apparatus having the charger, a total current of a predetermined level or more, which matches with the performance of the charger, is necessary for obtaining good electrification properties of the photosensitive member. In particular, in a life-time period of a charging wire, dispersed toner or an ozone product adheres to the charging wire and non-uniform electrification may occur. To prevent this, a set value of total current is increased.

However, since the amount of produced ozone is proportional to the total current, the amount of produced ozone increases if the set value of total current is raised in order to prevent non-uniform electrification. As a result, the concentration of ozone remaining in the charger increases accordingly. Thus, non-uniformity due to ozone increases.

Besides, during a copying operation or in a standby state, outside air is taken in for the purpose of cooling the electric components. This produces a wind within the apparatus and disperses ozone. If the power to the image forming apparatus is stopped, high-concentration ozone remains in the charger. Thereby, non-uniform electrification due to ozone occurs partly on the photosensitive body facing the charger. Consequently, when an image is formed the next time, a defective image with stripes may be formed.

BRIEF SUMMARY OF THE INVENTION

The object of the present invention is to provide an image forming apparatus and an image forming method, wherein non-uniform electrification is prevented and a defective image is prevented from being formed as a result of non-uniform electrification due to ozone.

In order to achieve the object, the present invention may provide an image forming apparatus for forming an image, the image forming apparatus including a photosensitive body which forms an electrostatic latent image, the apparatus comprising: charging means for charging the photosensitive body at a predetermined potential; first control means for setting a total current flowing in the charging means at a first set value during an image forming operation; and second control means for setting, when turn-off of power to the image forming apparatus has been instructed, the total current flowing in the charging means at a second set value different from the first set value, and controlling a finishing operation which leads to the turn-off of power.

The invention may provide an image forming method for an image forming apparatus for forming an image, the image forming apparatus having a charger which charges a photosensitive body for formation of an electrostatic latent image at a predetermined potential, the method comprising: setting a total current flowing in the charger at a first set value during an image forming operation in the image forming apparatus; setting, when turn-off of power to the image forming apparatus has been instructed, the total current flowing in the charger at a second set value lower than first set value; and executing a control to turn off the power to the image forming apparatus, including a control to turn off the total current flowing in the charger, after a predetermined time period has passed since the turn-off of power to the image forming apparatus was instructed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 1:
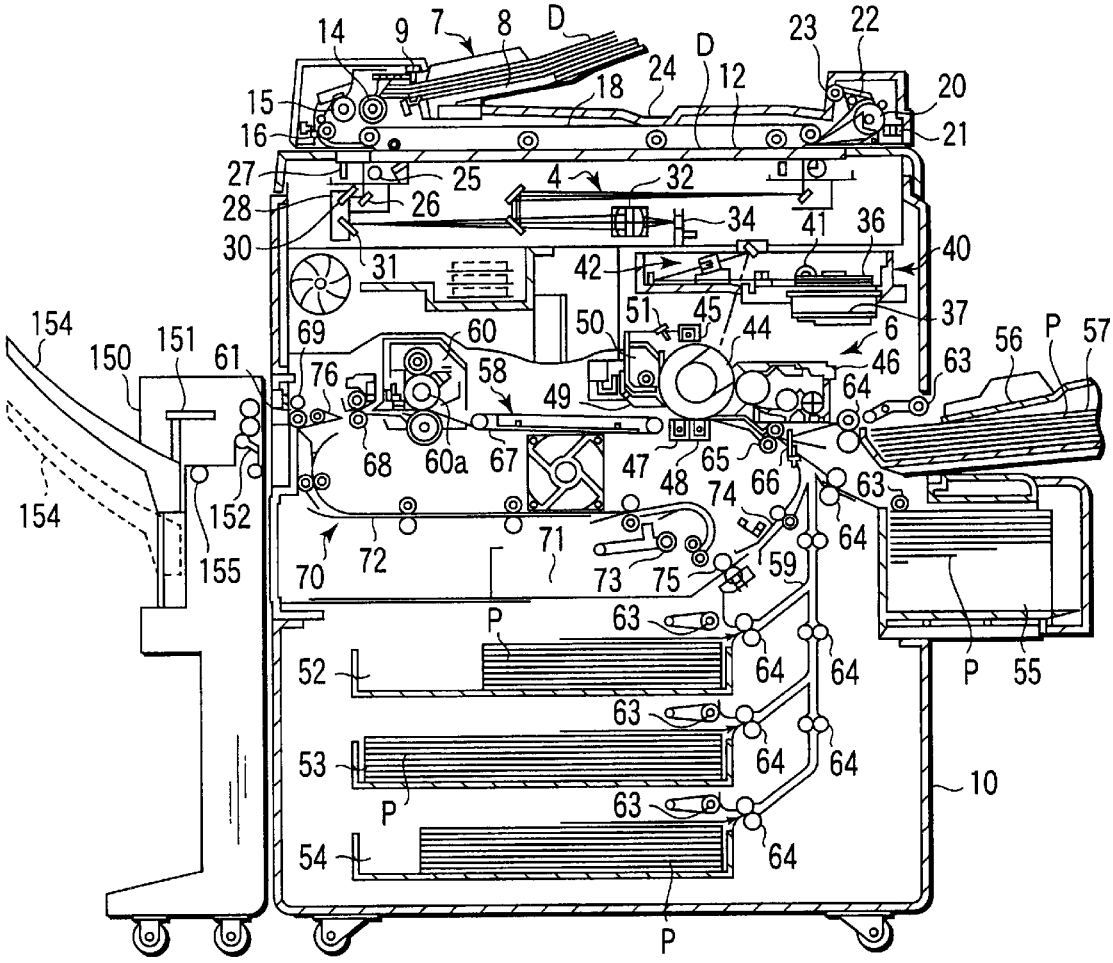
FIG. 1 is a cross-sectional view schematically showing an internal structure of a digital copying machine according to the present invention.

FIG. 1 is a cross-sectional view showing an internal structure of a digital copying machine (DPPC) according to the present invention.

In FIG. 1, the digital copying machine has an apparatus main body 10. The apparatus main body 10 incorporates a scanner section 4 functioning as an image reading device and a printer section 6 functioning as an image forming means.

An original table 12 formed of transparent glass, on which a read object, i.e. an original D is placed, is disposed on the upper surface of the apparatus main body 10. An automatic document feeder 7 (hereinafter referred to as "ADF") for automatically feeding originals onto the original table 12 is disposed on the upper surface of the apparatus main body 10. The ADF 7 is disposed to be opened/closed with respect to the original table 12 and serves as an original cover for bringing the original D placed on the original table 12 into close contact with the original table 12.

The ADF 7 has an original tray 8 on which the original D is set; an empty sensor 9 for detecting the presence/absence of originals; pickup rollers 14 for picking up originals on the original tray 8 one by one; a feed roller 15 for conveying the picked-up original; an aligning roller pair 16 for aligning the leading edges of the originals; and a conveyor belt 18 disposed to cover almost the entire surface of the original table 12. A plurality of originals set on the original tray 8 with their surfaces facing up are sequentially taken out from the lowermost page, i.e. the last page, aligned by the aligning roller pair 16, and conveyed to a predetermined position on the original table 12 by the conveyor belt 18.

In the ADF 7, a reversing roller 20, a non-reverse sensor 21, a flapper 22 and a delivery roller 23 are disposed at the end portion on the opposite side of the aligning roller pair 16 with respect to the conveyor belt 18. The original D whose image information has been read by the scanner section 4 is fed from the original table 12 by the conveyor belt 18 and delivered to an original delivery section 24 on the ADF 7 through the reversing roller 20, flapper 21 and delivery roller 22. To read the lower surface of the original D, the flapper 22 is switched. The original D conveyed by the conveyor belt 18 is reversed by the reversing roller 20 and fed to a predetermined position on the original table 12 again by the conveyor belt 18.

The scanner section 4 provided in the apparatus main body 10 has an exposure lamp 25 as a light source for illuminating the original D placed on the original table 12, and a first mirror 26 for deflecting reflection light from the original D in a predetermined direction. The exposure lamp 25 and first mirror 26 are attached to a first carriage 27 disposed under the original table 12.

The first carriage 27 is disposed to be movable in parallel to the original table 12 and reciprocally moved under the original table 12 by a scanning motor (not shown) through a toothed belt (not shown), etc.

A second carriage 28 movable in parallel to the original table 12 is disposed under the original table 12. Second and third mirrors 30 and 31 for successively deflecting reflection light from the original D, which has been deflected by the first mirror 26, are attached to the second carriage 28 at right angles with each other. The second carriage 28 is moved by, e.g. the toothed belt for driving the first carriage 27 along with the first carriage 27, and moved in parallel along the original table 12 at half the speed of the first carriage.

A focusing lens 32 for focusing reflection light from the third mirror 31 mounted on the second carriage 28, and a CCD (photoelectric conversion element) 34 for receiving the reflected light focused by the focusing lens and photoelectrically converting it are also disposed under the original table 12. The focusing lens 32 is disposed in a plane including the optical axis of the light deflected by the third mirror 31 so as to be movable by means of a driving mechanism. The focusing lens 32 moves to focus the reflection light at a desired magnification. The line sensor 34 photoelectrically converts the incoming reflection light and outputs an electrical signal corresponding to the read original D.

On the other hand, the printer section 6 has a laser exposure unit 40 functioning as a latent image forming means. The laser exposure unit 40 comprises a semiconductor laser 41 as a light source; a polygon mirror 36 as a scanning member for continuously deflecting a laser beam emitted by the semiconductor laser 41; a polygon motor 37 as a scanning motor for rotatably driving the polygon mirror 36 at a predetermined rotational speed (to be described later); and an optical system 42 for deflecting the laser beam from the polygon mirror 36 and guiding the beam to a photosensitive drum 44 (to be described later). The laser exposure unit 40 with the above structure is fixed to a support frame (not shown) of the apparatus main body 10.

The semiconductor laser 41 is ON/OFF-controlled in accordance with the image information of the original D read by the scanner section 4 or facsimile transmission/reception document information. The laser beam is directed to the photosensitive drum 44 through the polygon mirror 36 and optical system 42 to scan the outer surface of the photosensitive drum 44, thereby forming an electrostatic latent image on the outer peripheral surface of the photosensitive drum 44.

The printer section 6 has the rotatable photosensitive drum 44 as an image carrier disposed almost at the center of the apparatus main body 10. The outer peripheral surface of the photosensitive drum 44 is exposed to the laser beam from the laser exposure unit 40, and so a desired electrostatic latent image is formed thereon. Around the photosensitive drum 44, the following elements are arranged in the named order: a charger 45 for electrifying the outer peripheral surface of the drum with a predetermined charge; a developing device 46 for supplying toner as a developer to the electrostatic latent image formed on the outer peripheral surface of the photosensitive drum 44 to develop it at a desired image density; a transfer charger 48, which integrally includes a separation charger 47 for separating an image formation medium, i.e. a paper sheet P, fed from a paper cassette (to be described later) from the photosensitive drum 44, and transfers the toner image formed on the photosensitive drum 44 onto the paper sheet P; a separation gripper 49 for separating the paper sheet P from the outer peripheral surface of the photosensitive drum 44; a cleaning unit 50 for removing toner remaining on the outer peripheral surface of the photosensitive drum 44; and a charge erase device 51 for erasing charge on the outer peripheral surface of the photosensitive drum 44.

The photosensitive drum 44 has a cylindrical shape extending in a predetermined direction and is formed of organic photoconductor (OPC) which can be negatively charged and has a cross-sectional diameter of, e.g. 30 mm. The photosensitive drum 44 can be rotated at a predetermined speed by means of a motor (not shown).

An upper sheet cassette 52, a middle sheet cassette 53 and a lower sheet cassette 54 which can be drawn out of the apparatus main body are stacked at the lower portion of the apparatus main body 10. These cassettes 52 to 54 store paper sheets P of different sizes. A large-capacity feeder 55 is disposed on one side of these cassettes. This large-capacity feeder 55 stores about 3,000 paper sheets P having a size with high use frequency, e.g. paper sheets P with A4 size. A feed cassette 57 also serving as a manual feed tray 56 is detachably attached above the large-capacity feeder 55.

A convey path 58 extending from the sheet cassettes and the large-capacity feeder 55 through a transfer section located between the photosensitive drum 44 and transfer charger 48 is formed in the apparatus main body 10. A fixing unit 60 having a fixing lamp 60*a* is disposed at the end of the convey path 58. A delivery port 61 is formed in the side wall of the apparatus main body 10, which is opposed to the fixing unit 60. A single-tray finisher 150 is attached to the delivery port 61.

Pickup rollers 63 for taking out the paper sheets P one by one from the sheet cassette or large-capacity feeder are arranged near each of the upper sheet cassette 52, middle sheet cassette 53, lower sheet cassette 54 and feed cassette 57 and near the large-capacity feeder 55. A number of feed roller pairs 64 for conveying the paper sheet P taken out by the pickup rollers 63 through the convey path 58 are arranged in the convey path 58.

A registration roller pair 65 is arranged in the convey path 58 on the upstream side of the photosensitive drum 44. The registration roller pair 65 corrects a tilt of the extracted paper sheet P, registers the leading edge of the toner image on the photosensitive drum 44 and the leading edge of the paper sheet P, and feeds the paper sheet P to the transfer section at the same speed as the speed of movement of the outer peripheral surface of the photosensitive drum 44. A pre-aligning sensor 66 for detecting arrival of the paper sheet P is provided in front of the registration roller pair 65, i.e. on the feed roller 64 side.

Each paper sheet P extracted one by one from the sheet cassette or large-capacity feeder 55 by the pickup rollers 63 is fed to the registration roller pair 65 by the feed roller pair 64. After the leading edge of the paper sheet P is aligned by the registration roller pair 65, the paper sheet P is fed to the transfer section.

In the transfer section, a developer image, i.e. toner image formed on the photosensitive drum 44 is transferred onto the paper sheet P by the transfer charger 48. The paper sheet P on which the toner image has been transferred is separated from the outer peripheral surface of the photosensitive drum 44 by the function of the separation charger 47 and separation gripper 49 and conveyed to the fixing unit 60 through a conveyor belt 67 constituting part of the convey path 52. After the developer image is melted and fixed on the paper sheet P by the fixing unit 60, the paper sheet P is delivered onto the finisher 150 through the delivery port 61 by a feed roller pair 68 and a delivery roller pair 69.

An automatic double-side unit 70 for reversing the paper sheet P which has passed through the fixing unit 60 and feeding it to the registration roller pair 65 again is provided under the convey path 58. The automatic double-side unit 70 comprises a temporary stack 71 for temporarily stacking the paper sheets P; a reversing path 72 branched from the convey path 58 to reverse the paper sheet P which has passed through the fixing unit 60 and to guide the paper sheet P to the temporary stack 71; pickup rollers 73 for extracting the paper sheets P stacked on the temporary stack 71 one by one; and a feed roller 75 for feeding the extracted paper sheet P to the registration roller pair 65 through a convey path 74. A selector gate 76 for selectively distributing the paper sheets P to the delivery port 61 or reversing path 72 is provided at the branch portion between the convey path 58 and reversing path 72.

Where double-copying is performed, the paper sheet P which has passed through the fixing unit 60 is guided to the reversing path 72 by the selector gate 76, temporarily stacked on the temporary stack 71 in a reversed state, and fed to the registration roller pair 65 through the convey path 74 by the pickup rollers 73 and feed roller 75. The paper sheet P is registered by the registration roller pair 65 and fed to the transfer section again to transfer a toner image onto the reverse surface of the paper sheet P. Thereafter, the paper sheet P is delivered to the finisher 150 through the convey path 58, fixing unit 60 and delivery rollers 69.

The finisher 150 staples delivered copies of documents and stores them in units of a copy. Each time a paper sheet P to be stapled has been delivered from the delivery port 61, a guide bar 151 aligns the paper sheet P to the stapling side. When all paper sheets have been delivered, a copy of paper sheets P is pressed by a paper press arm 152 and stapled by a stapler unit (not shown). Then, the guide bar 151 moves downward. The stapled paper sheets P are delivered to a finisher delivery tray 154 by a finisher delivery roller 155 in units of a copy. The downward movement amount of the finisher delivery tray 154 is roughly determined in accordance with the number of paper sheets P to be delivered, and the finisher delivery tray 154 moves downward stepwise every time one copy is delivered. The guide bar 151 for aligning the delivered paper sheets P is located at such a high position that the guide bar 151 may not abut upon the already stapled paper sheets P placed on the finisher delivery tray 154.

The finisher delivery tray 154 is connected to a shift mechanism (not shown) which shifts (e.g. in four directions: front, rear, left and right sides) in units of a copy in the sort mode.

Figure 2:
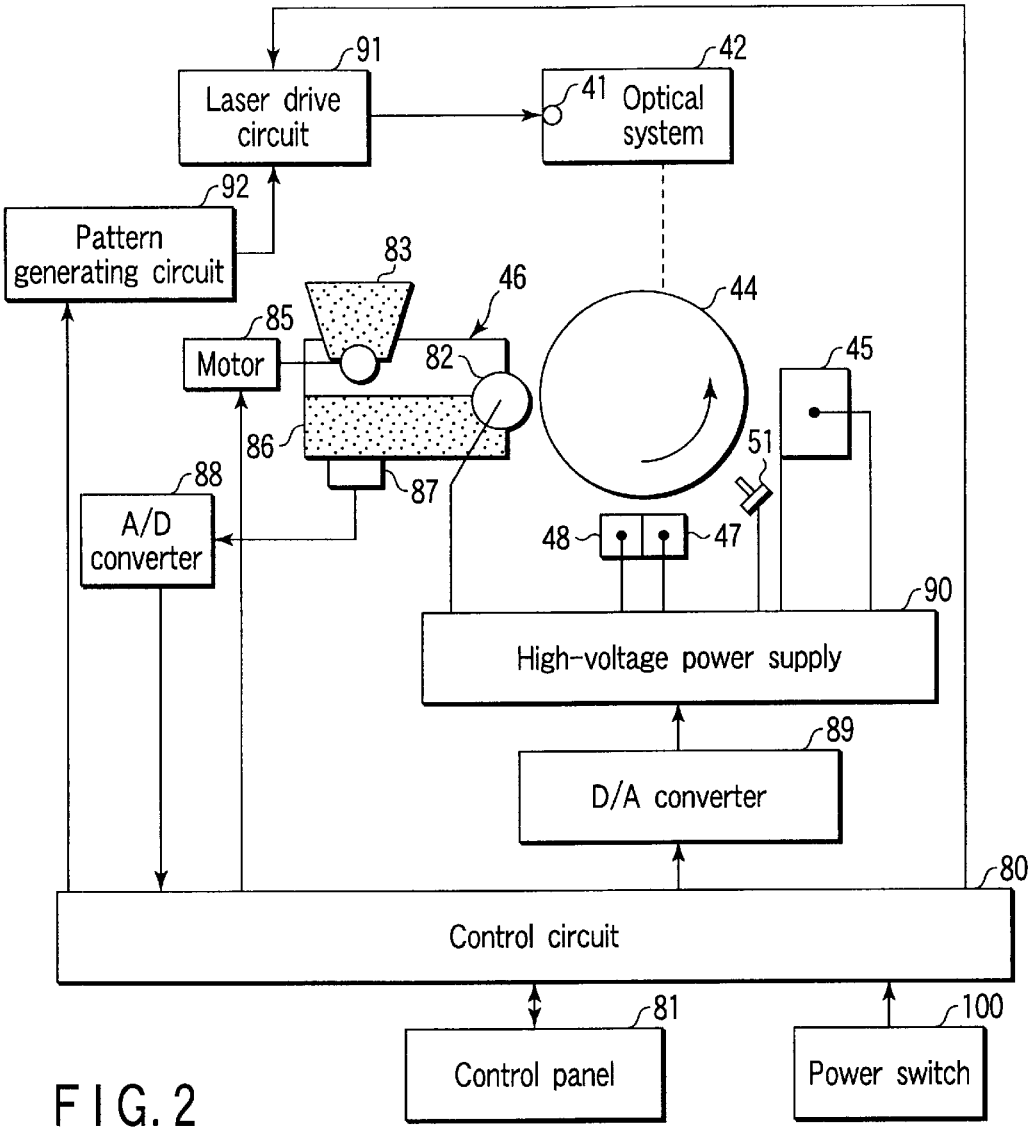
FIG. 2 is a block diagram schematically showing a main part of the digital copying machine of FIG. 1, electrical connection, and flow of signals for control.

FIG. 2 schematically shows a main part of the digital copying machine of FIG. 1, electrical connection, and flow of signals for control. Specifically, a control structure of the main part of the digital copying machine comprises a control circuit 80, a control panel 81, the photosensitive drum 44, the optical system 42, the charger 45, the developing device 46, the transfer charger 48, the separation charger 47, the charge erase device 51, and a power switch 100.

The control circuit 80 controls the entirety of the digital copying machine.

The control panel 81 includes a liquid crystal display section (not shown) for displaying various operational guidance information. In addition, it includes a touch panel (not shown) or hard keys (not shown) such as numeral keys for operational inputs by the user.

The developing device 46 comprises a developing roller 82 for developing with toner an electrostatic latent image formed on the photosensitive drum 44 by reverse rotation; a hopper 83 for supplying toner; a motor 85 to be driven to supply toner from the hopper 83; a density sensor 87 for sensing the density of toner 86; and an A/D converter 88 for converting an analog signal from the density sensor 87 to a digital signal.

The control circuit 80 controls a high-voltage power supply 90 via a D/A converter 89, and a laser drive circuit 91.

The high-voltage power supply 90 is controlled by the control circuit 80 to supply a charging voltage to the charger 45, a development bias to the developing roller 82, a transfer voltage to the transfer charger 48, and a separation AC voltage and a separation DC voltage to the separation charger 47.

The control circuit 80 modulates and controls, via a pattern generating circuit 92 and the laser drive circuit 91, a laser beam emitted from a semiconductor laser 41 provided in the optical system 42 in accordance with image data.

The control circuit 80 drives and controls the motor 85 in accordance with toner density sensed by the density sensor 87 of the developing device 46.

The power switch 100 is provided on a side face of the apparatus main body 10 and instructs power ON/OFF of the digital copying machine.

Figure 3:
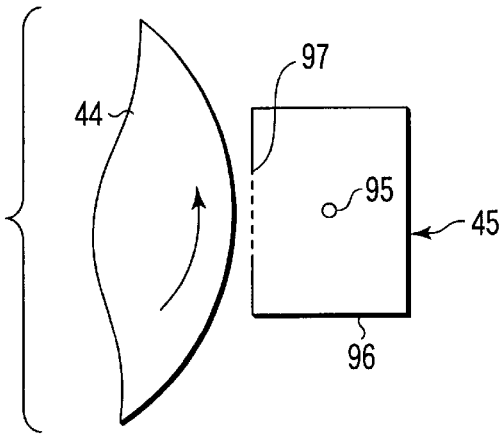
FIG. 3 shows an example of a charger.

FIG. 3 shows an example of the charger 45. As is shown in FIG. 3, the charger 45 comprises a charging wire 95 which extends substantially in parallel with the cylindrical photosensitive drum 44 and is supplied with a high voltage of several KV; and a metallic case which directs the charging wire 95 toward the photosensitive drum 44 and holds it with a predetermined distance from the surface of the drum. The case 96 of the charger 45 has a mesh-like charging grid 97 on its side facing the photosensitive drum 44.

The charging wire 95 has a diameter of 40 to 80 μm and is formed of tungsten oxide, gold plating, etc. The charging wire 95 is supplied with a high voltage of several KV to produce ions. The case 96 enclosing the charging wire 95 has a width of, e.g. about 10 mm, and is formed of stainless steel, aluminum, zinc-plated steel, etc.

The charging grid 97 is formed by photo-etching a stainless steel plate having a thickness of about 100 μm or by punching a thin zinc-plated steel plate. The charging grid 97 has mesh-like openings with intervals of about 0.5 to 1.5 mm.

The charging grid 97 is disposed to face the surface of the photosensitive drum 44 with a distance of 1 mm. A grid voltage is applied to the charging grid 97 as well as the case 96. The surface potential of the photosensitive drum 44 can be controlled by the magnitude of the grid voltage.

The charger 45 with this structure applies to the surface of photosensitive drum 44 discharge electricity produced among the charging wire 95, case 96 and charging grid 97, and electrifies the surface of photosensitive drum 44. At this time, ozone is produced as a by-product of the discharge.

Figure 4:
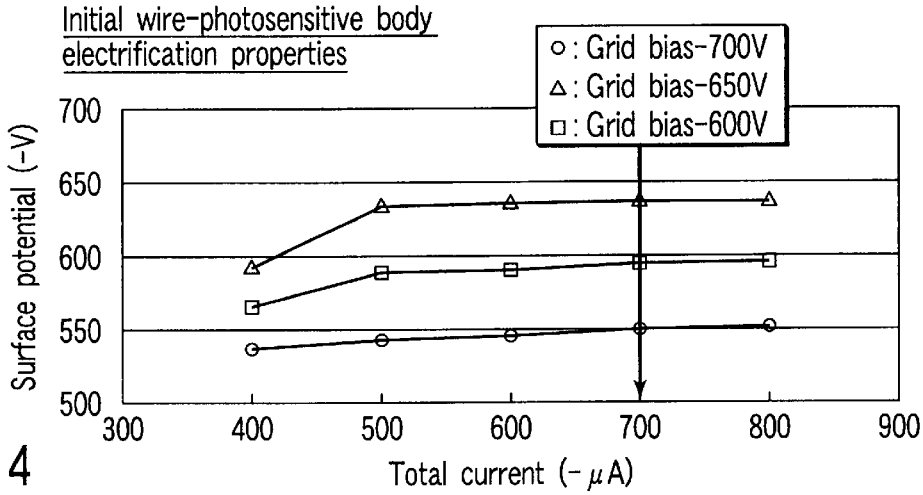
FIG. 4 shows the relationship between a total current of the charger and electrification properties of a photosensitive drum.
Figure 5:
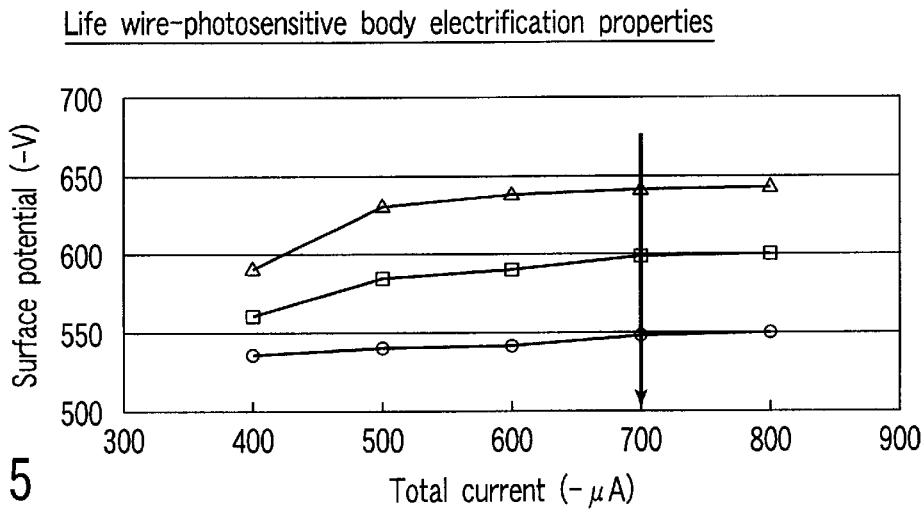
FIG. 5 shows the relationship between a total current of the charger and electrification properties of the photosensitive drum.
Figure 6:
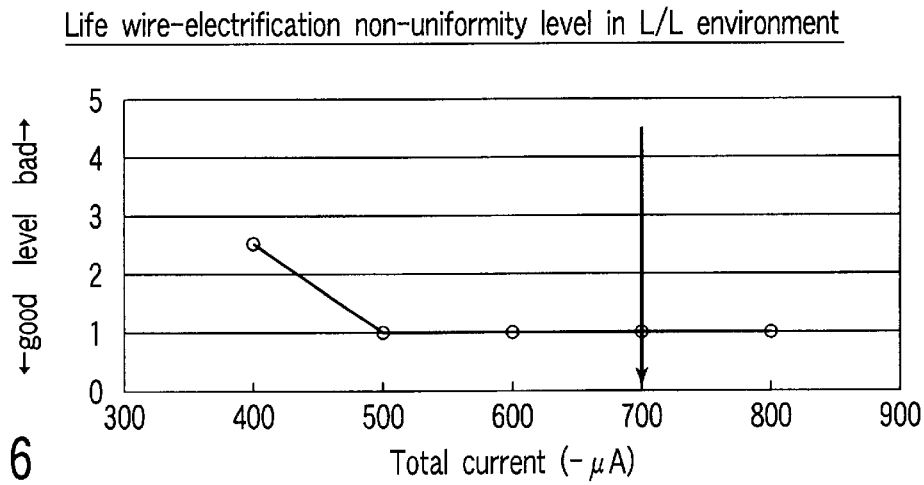
FIG. 6 shows the relationship between a total current of the charger and electrification properties of the photosensitive drum.

FIGS. 4, 5 and 6 show the relationship between the total charge current of the charger 45 and the electrification properties of the photosensitive drum 44.

FIG. 4 shows the relationship between an initial wire of the charger 45 and a surface potential of the photosensitive drum 44. The ordinate indicates the surface potential (−V) of the photosensitive drum 44, and the abscissa indicates a total current (−μA) of the initial wire. A line graph connecting symbols ○ indicates a case where the grid bias is −700V. A line graph connecting symbols Δ indicates a case where the grid bias is −650V. A line graph connecting symbols □ indicates a case where the grid bias is −600V.

For example, when the total current of the initial wire is −700 μA and the grid bias is −600V, the surface potential of the photosensitive drum 44 is −550V. When the total current of the initial wire is −800 μA and the grid bias is −650V, the surface potential of the photosensitive drum 44 is −598V.

FIG. 5 shows the relationship between a life wire of the charger 45 and a surface potential of the photosensitive drum 44. Like FIG. 4, the ordinate indicates the surface potential (−V) of the photosensitive drum 44, and the abscissa indicates a total current (−μA) of the life wire. A line graph connecting symbols ○ indicates a case where the grid bias is −700V. A line graph connecting symbols Δ indicates a case where the grid bias is −650V. A line graph connecting symbols □ indicates a case where the grid bias is −600V.

For example, when the total current of the life wire is −700 μA and the grid bias is −600V, the surface potential of the photosensitive drum 44 is −548V. When the total current of the life wire is −800 μA and the grid bias is −650V, the surface potential of the photosensitive drum 44 is −600V.

FIG. 6 shows the relationship between a total current and an electrification non-uniformity level in the charger 45 in a life wire L/L environment. The ordinate indicates an electrification non-uniformity level by values 0, 1, 2, 3, 4 and 5, with "0" representing the best level and "5" representing the worst level. The abscissa indicates a total current (−μA).

For example, when the total current is −400 μA, the electrification non-uniformity level is "2.5". When the total current is −500 μA, the electrification non-uniformity level is "1". When the total current is −600 μA, the electrification non-uniformity level is "1". When the total current is −700 μA, the electrification non-uniformity level is "1". When the total current is −800 μA, the electrification non-uniformity level is "1".

It is understood from FIGS. 4, 5 and 6 that the total current of −600 μA or more is required to meet the electrification properties of the photosensitive drum 44, in consideration of the stability of the surface potential of photosensitive drum 44 and the electrification non-uniformity level with respect to the charger 45.

Figure 7:
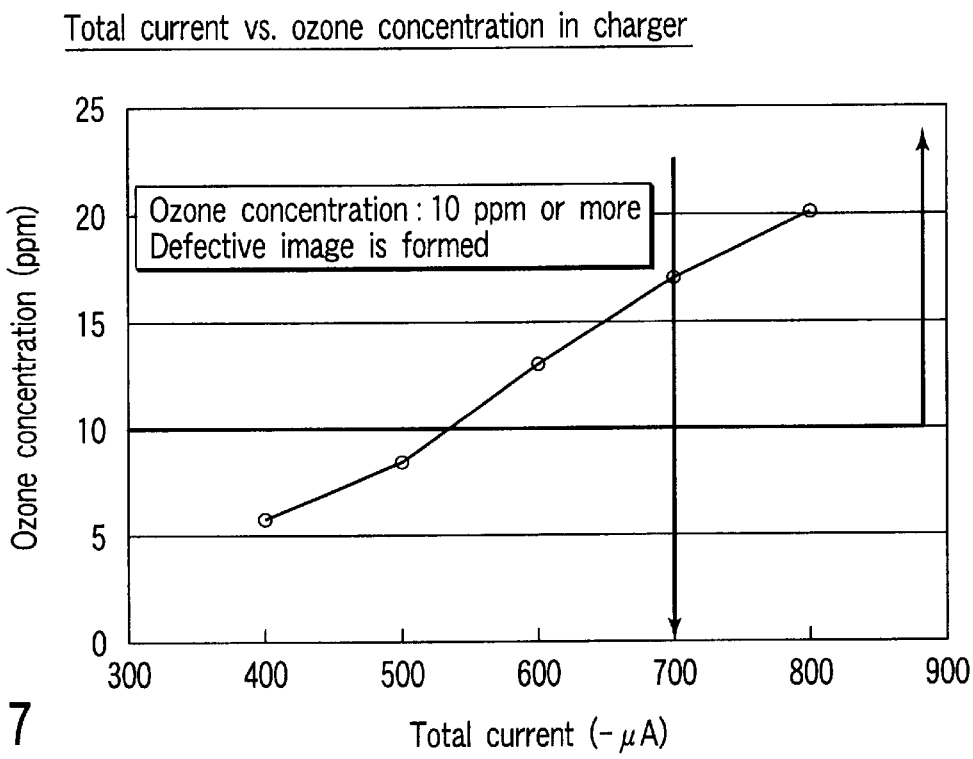
FIG. 7 shows the relationship between a total current of the charger and an ozone concentration in the charger.

FIG. 7 shows the relationship between the total current supplied to the charger 45 and the ozone concentration within the charger 45. As is shown in FIG. 7, the ozone concentration in the charger 45 is proportional to the total current to the charger 45. Specifically, when the total current is −400 μA, the ozone concentration is 6 ppm. When the total current is −500 μA, the ozone concentration is 8 ppm. When the total current is −600 μA, the ozone concentration is 13 ppm. When the total current is −700 μA, the ozone concentration is 17 ppm. When the total current is −800 μA, the ozone concentration is 20 ppm.

It is understood from FIG. 7 that the total current needs to be set at −500 μA or less in order to prevent a defective image, since such a defective image is formed when the ozone concentration is 10 ppm or more.

From FIGS. 4, 5, 6 and 7, it is understood that there is no region of setting of the total current, where the stability of surface potential of the photosensitive drum 44 and the electrification non-uniformity level are satisfied and a defective image is not caused by non-uniform electrification due to ozone.

Moreover, in the copying operation, it is necessary to satisfy both the stability of surface potential of the photosensitive drum 44 and the electrification non-uniformity level. It is thus not possible to set the total current to the charger 45 at less than −600 μA.

In the present invention, under the circumstances, when the stop of power to the image forming apparatus is instructed, the apparatus is not immediately stopped. Instead, a finishing operation is performed, and while the finishing operation is being performed, the total current to the charger is set to be lower than the set value in the copying operation in order to decrease the ozone concentration in the charger.

It is not possible to decrease the total current to the charger to zero in the finishing operation. The reason is that since the development bias is being applied to the developing roller in the finishing operation, a great amount of toner adheres to the surface of the photosensitive drum if the photosensitive drum is not electrified.

Figure 8:
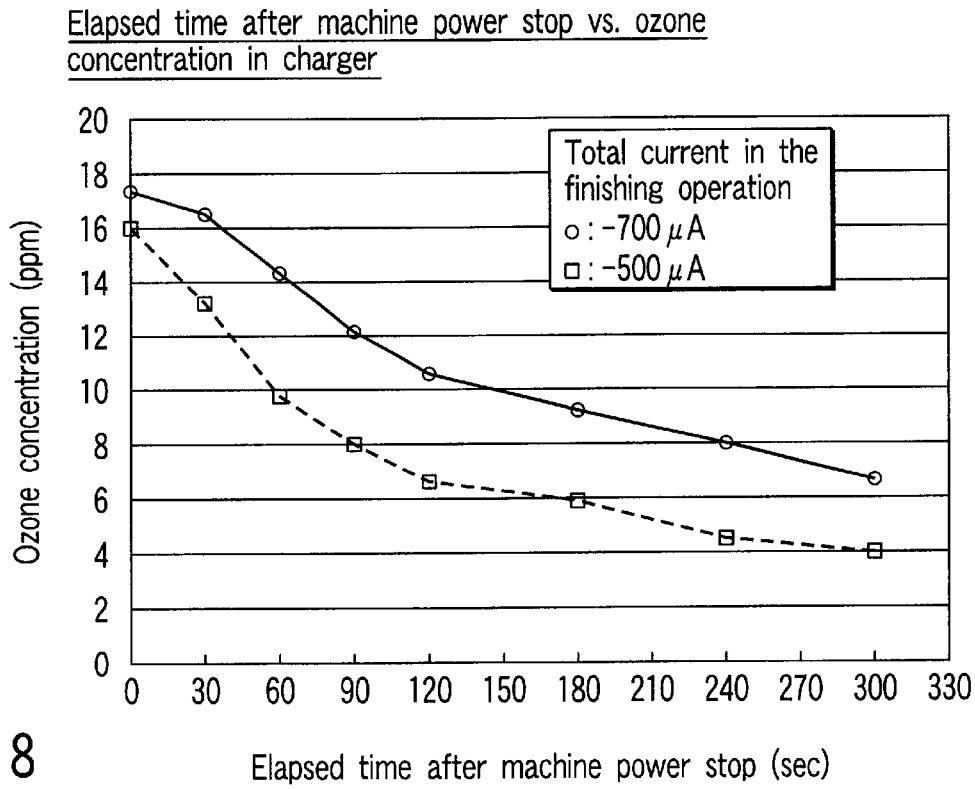
FIG. 8 shows the relationship between an elapsed time after the finish of a copying operation and an ozone concentration in the charger.

FIG. 8 shows the relationship between an elapsed time in the finishing operation performed by the instruction to stop the power to the digital copying machine (machine) and the ozone concentration in the charger 45. FIG. 8 shows the variation in the ozone concentration in the charger 45 in relation to the elapsed time in the finishing operation performed by the instruction to stop the power to the digital copying machine. Specifically, FIG. 8 shows comparison between a case (−500 μA: line graph connecting symbols □) where the total current in the finishing operation is made lower than the set value (−700 μA) in the copying operation and a case (−700 μA: line graph connecting symbols ○) where the total current is unchanged.

As is indicated by the line graph connecting symbols □ in FIG. 8, if the total current in the finishing operation is decreased to −500 μA, the concentration of residual ozone immediately after the instruction to stop the power to the digital copying machine decreases. Thereby, the time needed to decrease the ozone concentration to 10 ppm or less, at which no defective image is formed, can be reduced to ½.

Figure 9:
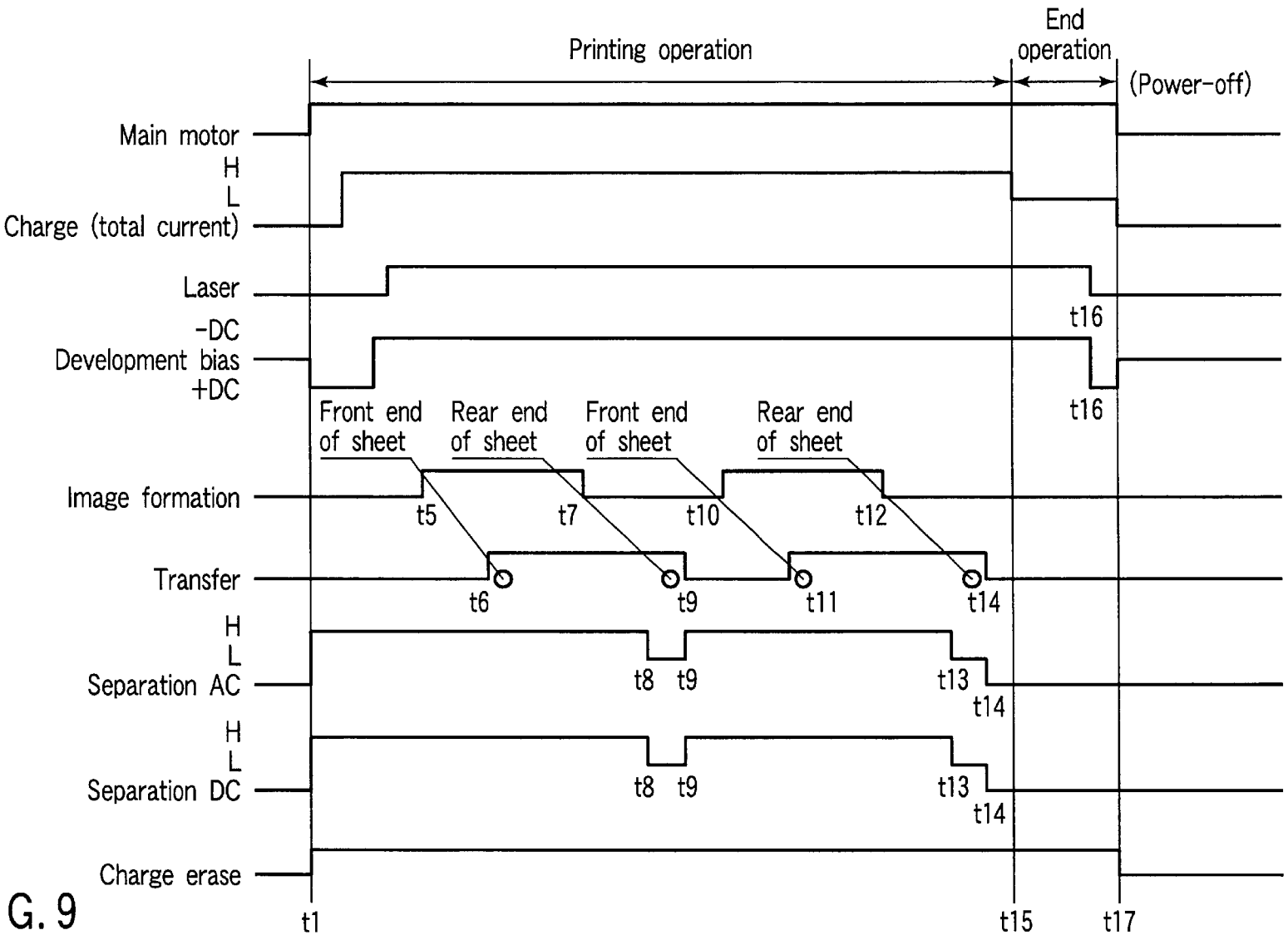
FIG. 9 is a time chart illustrating an operation control in the present invention.

An operation control in the digital copying machine with the above structure will now be described with reference to a time chart of FIG. 9. This time chart illustrates a printing operation for copying two pages and a finishing operation beginning from the turning off by the power switch 100 that instructs the stop of power to the digital copying machine.

At time t1, assume that the power supply is already turned on by the power switch 100.

When the copying operation is set through the control panel 81 and the start of the copying operation is instructed, the control circuit 80 controls the start of operations of respective sections at time t1.

The control circuit 80 drives the main motor (not shown).

In addition, the control circuit 80 controls the D/A converter 89 to cause the high-voltage power supply 90 to apply a development bias of +DC to the developing roller 82, a high-level separation AC voltage to the separation charger 47, a high-level separation DC voltage to the separation charger 47, and a charge erase voltage to the charge erase device 51.

At time t2, the control circuit 80 controls the D/A converter 89 to cause the high-voltage power supply 90 to supply a high-level total current to the charger 45. For example, the total current is set at a high level of −700 μA.

At time t3, the control circuit 80 controls the D/A converter 89 to cause the high-voltage power supply 90 to apply a development bias of −DC to the developing roller 82.

At time t4, the control circuit 80 controls the laser drive circuit 91 to cause the semiconductor laser 41 in optical system 42 to emit a laser beam. At times t5 to t7, the control circuit 80 controls the pattern generating circuit 92 to control the laser beam emitted from the semiconductor laser 41 based on image data of the first page for image formation.

When a front edge portion of a paper sheet, which is an image formation medium for the first page, has been conveyed to the photosensitive drum 44, the control circuit 80 controls, at time t6, the D/A converter 89 to cause the high-voltage power supply 90 to apply a transfer voltage to the transfer charger 48.

At time t8, the control circuit 80 controls the D/A converter 89 to cause the high-voltage power supply 90 to apply a low-level separation AC voltage to the separation charger 47 and also a low-level separation DC voltage to the separation charger 47.

When a rear edge of the paper sheet has gone away from the photosensitive drum 44, the control circuit 80 controls, at time t9, the D/A converter 89 to cause the high-voltage power supply 90 to turn off the transfer voltage to the transfer charger 48, to apply a high-level separation AC voltage to the charger 47, and to apply a high-level separation DC voltage to the separation charger 47.

At times t10 to t12, the control circuit 80 controls once again the pattern generating circuit 92 to control the laser beam emitted from the semiconductor laser 41 based on image data of the second page for image formation.

When a front edge portion of a paper sheet, which is an image formation medium for the second page, has been conveyed to the photosensitive drum 44, the control circuit 80 controls, at time t11, the D/A converter 89 to cause the high-voltage power supply 90 to apply a transfer voltage to the transfer charger 48.

At time t13, the control circuit 80 controls the D/A converter 89 to cause the high-voltage power supply 90 to apply a low-level separation AC voltage to the separation charger 47 and also a low-level separation DC voltage to the separation charger 47.

When a rear edge of the paper sheet has gone away from the photosensitive drum 44, the control circuit 80 controls, at time t14, the D/A converter 89 to cause the high-voltage power supply 90 to turn off the transfer voltage to the transfer charger 48, to turn off the separation AC voltage to the separation charger 47 and to turn off the separation DC voltage to the separation charger 47.

At time t15, when the power supply has been turned off by the power switch 100, the control circuit 80 completes the printing operation and controls the finishing operation.

When the finishing operation is started at time t15, the control circuit 80 controls the D/A converter 89 to cause the high-voltage power supply 90 to supply a low-level total charge current to the charger 45. For example, the high-level total charge current of −700 μA, as mentioned above, is changed to the low-level total current of −500 μA.

However, if the total charge current is extremely lowered, another problem may arise. Because of the width of the case of the charger 45, the mesh shape of the grid, etc., the total current is not reduced to ½. Thus, the total current is decreased from −700 μA to −500 μA, as mentioned above.

At time 16, the control circuit 80 controls the laser drive circuit 91 to turn off the laser beam emitted from the semiconductor laser 41 in optical system 42. The control circuit 80 also controls the D/A converter 89 to cause the high-voltage power supply 90 to apply a development bias of +DC to the developing roller 82.

At time t17 at the end of the finishing operation, the control circuit 80 stops the main motor (not shown) and controls the D/A converter 89 to cause the high-voltage power supply 90 to turn off the total current to the charger 45, to turn off the development bias to the developing roller 82 and to turn off the charge erase voltage to the charge erase device 51.

The power to the digital copying machine is stopped when the control of the finishing operation is completed.

Although ozone is produced in the separation charger 47, it does not affect the image formation. Besides, although ozone is produced in the transfer charger 48, there is no effect of this ozone in normal cases.

As has been described above, according to the embodiment of the present invention, the total current to the charger can be set such that the stability of surface potential of the photosensitive drum and the electrification non-uniformity level are satisfied and a defective image is not caused by non-uniform electrification due to ozone.

The present invention can easily be carried out since no space for installation is required, unlike the case where the structure of the image forming apparatus is modified, for example, by providing an air suction duct.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus for forming an image, the image forming apparatus including a photosensitive body which forms an electrostatic latent image, the apparatus comprising:

charging means for charging a surface of the photosensitive body at a predetermined potential using a corona discharge;

first control means for setting a total current flowing in the charging means at a first set value during an image forming operation; and second control means for setting, when turn-off of power to the image forming apparatus has been instructed, the total current flowing in the charging means at a second set value different from said first set value, and controlling a finishing operation which leads to the turn-off of power.

2. An image forming apparatus according to claim 1, wherein said second control means sets the total current flowing in the charging means at the second set value which is lower than the first set value.

3. An image forming apparatus according to claim 1, wherein said first control means controls the first set value at −700 $\mu$A, and said second control means controls the second set value at −500 $\mu$A.

4. An image forming apparatus for forming an image, the image forming apparatus including a photosensitive body which forms an electrostatic latent image, the apparatus comprising:

a charger which charges a surface of the photosensitive body at a predetermined potential using a corona discharge;

first control means for setting a total current flowing in the charger at a first set value during an image forming operation;

a power switch which turns on/off power to the image forming apparatus; and second control means for setting, when the power has been turned off by the power switch, the total current flowing in the charging means at a second set value lower than said first set value, and executing a control to turn off the power to the image forming apparatus after a predetermined time period has passed.

5. An image forming method for an image forming apparatus for forming an image, the image forming apparatus including a photosensitive body which forms an electrostatic latent image, the method comprising:

charging a surface of the photosensitive body at a predetermined potential using a corona discharge;

setting a total current flowing in the charger at a first set value during an image forming operation in the image forming apparatus;

setting, when turn-off of power to the image forming apparatus has been instructed, the total current flowing in the charger at a second set value lower than first set value; and executing a control to turn off the power to the image forming apparatus, including a control to turn off the total current flowing in the charger, after a predetermined time period has passed since the turn-off of power to the image forming apparatus was instructed.

* * * * *